US006694692B2

(12) United States Patent
Piccone

(10) Patent No.: US 6,694,692 B2
(45) **Date of Patent: *Feb. 24, 2004**

(54) MODULAR FORMWORK ELEMENTS AND ASSEMBLY

(76) Inventor: Francesco Piccone, 1611 Cedar Crescent, Vancouver (CA), V6J 2P8

( * ) Notice: Subject to any disclaimer, the term of this patent is extended or adjusted under 35 U.S.C. 154(b) by 0 days.

This patent is subject to a terminal disclaimer.

(21) Appl. No.: 10/177,753

(22) Filed: Jun. 24, 2002

(65) Prior Publication Data

US 2003/0009967 A1 Jan. 16, 2003

Related U.S. Application Data

(62) Division of application No. 09/174,304, filed on Oct. 16, 1998, now Pat. No. 6,435,471.

(51) Int. Cl.[7] ..... E04B 2/46

(52) U.S. Cl. ..... 52/426; 52/270; 52/309.11; 52/379; 52/404.1; 52/417; 52/431; 52/439; 52/468; 249/45; 249/47; 249/38; 249/191; 249/194

(58) Field of Search ..... 52/426, 439, 431, 52/417, 468, 379, 270, 309.11, 404.1; 249/45, 47, 38, 191, 194

(56) References Cited

U.S. PATENT DOCUMENTS

| | | | | | |
|---|---|---|---|---|---|
| 510,720 | A | * | 12/1893 | Stewart, Jr. | 52/279 |
| 1,244,608 | A | | 10/1917 | Hicks | |
| 1,715,466 | A | * | 6/1929 | Miller | 52/236.2 |
| 2,008,162 | A | | 7/1935 | Waddell | |
| 2,050,258 | A | * | 8/1936 | Bemis | 249/34 |
| 2,172,052 | A | | 9/1939 | Robbins | |
| 2,861,277 | A | * | 11/1958 | Hermann | 220/642 |
| 2,892,340 | A | | 6/1959 | Fort | |

(List continued on next page.)

FOREIGN PATENT DOCUMENTS

| | | | | |
|---|---|---|---|---|
| CA | 574720 | | 4/1959 | |
| CA | 957816 | * | 11/1974 | 249/47 |
| CA | 1316366 | | 4/1993 | |
| CH | 317758 | | 1/1957 | |
| DE | 1684357 | * | 4/1967 | 249/47 |
| DE | 1812590 | | 6/1970 | |
| DE | 3234489 | | 8/1984 | |
| DE | 3003446 | | 4/1987 | |
| DE | 3727956 | | 5/1988 | |
| EP | 0025420 | | 3/1981 | |
| FR | 507787 | | 9/1920 | |
| FR | 1381945 | | 2/1963 | |
| FR | 1603005 | | 3/1971 | |
| FR | 2721054 | | 6/1994 | |
| GB | 2205624 | | 2/1988 | |
| IT | 581408 | | 9/1958 | |
| NO | 46428 | | 4/1929 | |
| SE | 206538 | | 9/1966 | |
| WOWO | PCT/AU82/00080 | | 5/1982 | |
| WOWO | PCT/NO94/00112 | | 6/1994 | |
| WOWO | PCT/AU95/00576 | | 9/1995 | |

*Primary Examiner*—Carl D. Friedman
*Assistant Examiner*—Christy Green
(74) *Attorney, Agent, or Firm*—Bereskin & Parr

(57) ABSTRACT

A modular assembly for creating formwork for casting vertical concrete structures is characterized by elongated wall elements which are disposed in edge to edge relationship in two facing rows and which are simultaneously retained in edge to edge relationship and in facing relationship by connecting members. Retaining elements slidably engage connecting members and wall elements in diagonal relationship. Connecting members include engagement means for cooperating with notches in rigid panels which are disposed against the interior surfaces of flat walls formed by the formwork.

15 Claims, 6 Drawing Sheets

U.S. PATENT DOCUMENTS 3,100,677 A * 8/1963 Frank et al. ..... 264/71
3,196,990 A * 7/1965 Handley ..... 52/732.3
3,288,427 A 11/1966 Pluckebaum
3,291,437 A * 12/1966 Bowden et al. ..... 249/48
3,588,027 A * 6/1971 Bowden ..... 249/48
3,788,020 A 1/1974 Gregori
3,951,294 A * 4/1976 Wilson ..... 220/4.31
4,060,945 A * 12/1977 Wilson ..... 52/169.5
4,106,233 A * 8/1978 Horowitz ..... 47/44
4,180,956 A * 1/1980 Gross ..... 52/407.1
4,276,730 A 7/1981 Lewis
4,433,522 A * 2/1984 Yerushalmi ..... 52/426
4,532,745 A * 8/1985 Kinard ..... 52/251
4,550,539 A * 11/1985 Foster ..... 52/236.1
4,553,875 A 11/1985 Casey
4,731,964 A * 3/1988 Phillips ..... 52/106
4,731,971 A * 3/1988 Terkl ..... 52/742.14
4,742,665 A * 5/1988 Baierl ..... 52/276
4,946,056 A * 8/1990 Stannard ..... 220/584
4,995,191 A * 2/1991 Davis ..... 47/32.7
5,014,480 A * 5/1991 Guarriello et al. ..... 52/309.12
5,216,863 A * 6/1993 Nessa et al. ..... 52/439
5,491,947 A * 2/1996 Kim ..... 52/426
5,553,430 A * 9/1996 Majnaric et al. ..... 52/236.8
5,740,648 A * 4/1998 Piccone ..... 52/426
6,212,845 B1 * 4/2001 De Zen ..... 52/607
6,219,984 B1 * 4/2001 Piccone ..... 52/426
6,220,779 B1 * 4/2001 Warner et al. ..... 403/381
6,435,470 B1 * 8/2002 Lahham et al. ..... 248/638

* cited by examiner

MODULAR FORMWORK ELEMENTS AND ASSEMBLY

This application is a divisional of U.S. patent application Ser. No. 09/174,304 filed Oct. 16, 1998 now U.S. Pat. No. 6,435,471.

TECHNICAL FIELD OF THE INVENTION

This invention relates to formwork for casting vertical concrete structures such as walls, wherein forms or elongated modular elements are adapted to interconnect to one another along their longitudinal sides to create overall formwork.

BACKGROUND ART

It is known in the prior art to provide modular form elements which interconnect to form a wall structure into which concrete may be poured or into which insulation may be inserted. An example of such elements is disclosed in PCT application PCT/CA 95/00281 by Piccone. The structure disclosed in PCT/CA95/00281 comprises a plurality of elongated and generally concave elements which are placed edge to edge to form parallel faces of a wall. The two faces of the wall are connected by connecting members extending between the two wall faces. The connecting members are in sliding engagement with the concave elements. The connecting members also serve to simultaneously connect adjacent concave elements of each wall to one another.

The structure and modular elements described in PCT/CA 95/00281 result in a wall having a uniform columnar appearance. However, it is sometimes desired to construct a wall having one or both of its sides flat.

It is therefore an object of this invention to provide improved modular formwork elements for use in a formwork assembly which provide versatility in the shape of the wall to be constructed, including the ability to form a wall having at least one flat side.

It is a further object of the invention to prevent bulging of the formwork under the pressure of poured concrete against a flat wall face and to provide improved strength for the overall formwork.

SUMMARY OF THE INVENTION

The invention comprises a kit, an assembly and individual elements for formwork for erecting a wall structure wherein a plurality of elongated wall elements having engagement means about their longitudinal edges are presented in edge to edge relationship in two spaced parallel rows and a connecting member having engagement means slidingly extends between the parallel rows so as to simultaneously engage two edge adjacent wall elements in one row and two edge adjacent wall elements in the parallel row, the elongated wall elements which define at least one of said parallel rows being substantially flat on one side.

According to the invention, a formwork element is provided which is elongated and has a flat central portion extending between two longitudinal edges. One of the longitudinal edges is provided with engagement means extending at substantially a 45 degree angle with respect to said central portion and the other of said longitudinal edges is provided with engagement means extending at substantially a 135 degree angle in relation to said central portion. The engagement means of the formwork element are adapted to slidingly engage said engagement means of said substantially flat wall elements and said engagement means of said connecting member.

In another aspect of the invention, rigid panels extend substantially between adjacent pairs of connecting members and against an interior surface of a flat wall formed by flat wall elements disposed in edge to edge relationship.

In another aspect of the invention, the connecting member is elongated and comprises a substantially straight portion extending between two longitudinal edges. Each of longitudinal edge is provided with two elongated engagement means disposed in symmetrical opposed relationship about the plane of the straight portion, each of said engagement means of said connecting member being adapted for sliding engagement with the engagement means of the wall elements.

In another aspect of the invention, the connecting member further comprises at least one elongated supplementary engagement means spaced inwardly from one of said longitudinal edges.

In another aspect of the invention, a flat wall defining element is elongated and comprises a portion extending between two longitudinal edges which portion is flat on one of its surfaces. Each longitudinal edge is provided with elongated engagement means adapted for sliding engagement with the engagement means of said connecting member.

Other aspects of the invention are described in the description of the preferred and alternate embodiments below and in the claims.

BRIEF DESCRIPTION OF THE DRAWINGS

The invention will be more fully appreciated by reference to the following description of the preferred embodiment thereof in conjunction with the drawings in which.

DETAILED DESCRIPTION OF THE BEST MODE AND PREFERRED EMBODIMENT OF THE INVENTION

Figure 1:
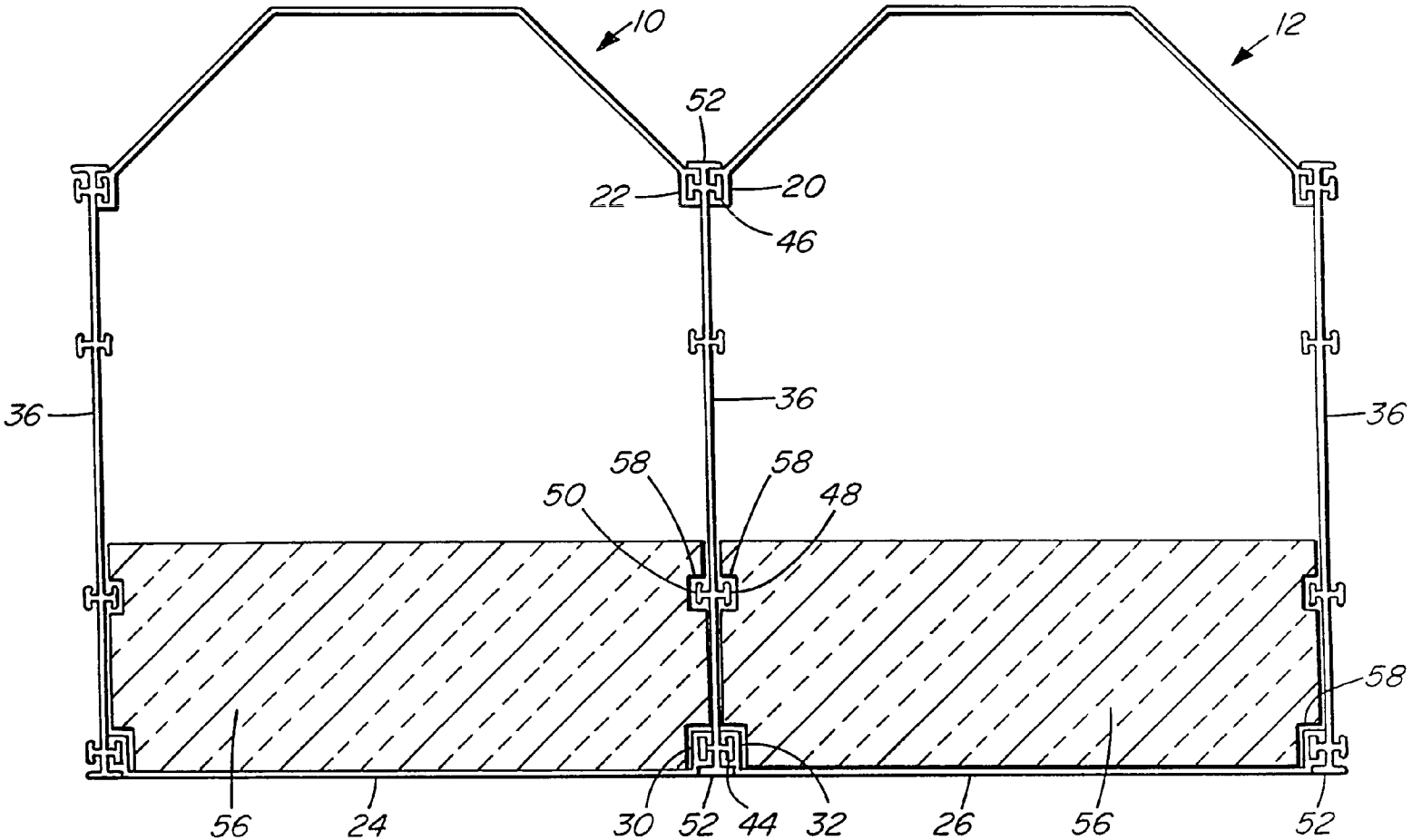
FIG. 1 is a schematic plan view of an assembly of formwork illustrating connecting members and wall elements according to the invention to produce a wall having one flat side and one columnar side.

Formwork for a wall presenting one side having a columnar external appearance and another side having a flat external appearance is illustrated in FIG. 1. Each of the formwork elements shown in FIG. 1 is elongated into the plane of the figure and includes longitudinal edges which also extend into the plane of the figure.

The formwork is created by placing a course of wall elements adjacent one another in edge to edge relationship, as between identical wall elements 10 and 12. A second course of elements is then placed adjacent one another in edge to edge relationship, as between identical wall elements 24 and 26. The various elements are then interconnected by means of connecting members 36, as described below.

Two embodiments of wall elements have thus far been illustrated. Wall elements 10, 12 may be used to present a columnar external appearance to the assembled formwork and accordingly to the wall. Wall elements 24, 26 may be used to present a flat external appearance. The wall elements are preferably made of a material such as polyvinyl chloride.

Figure 2A:
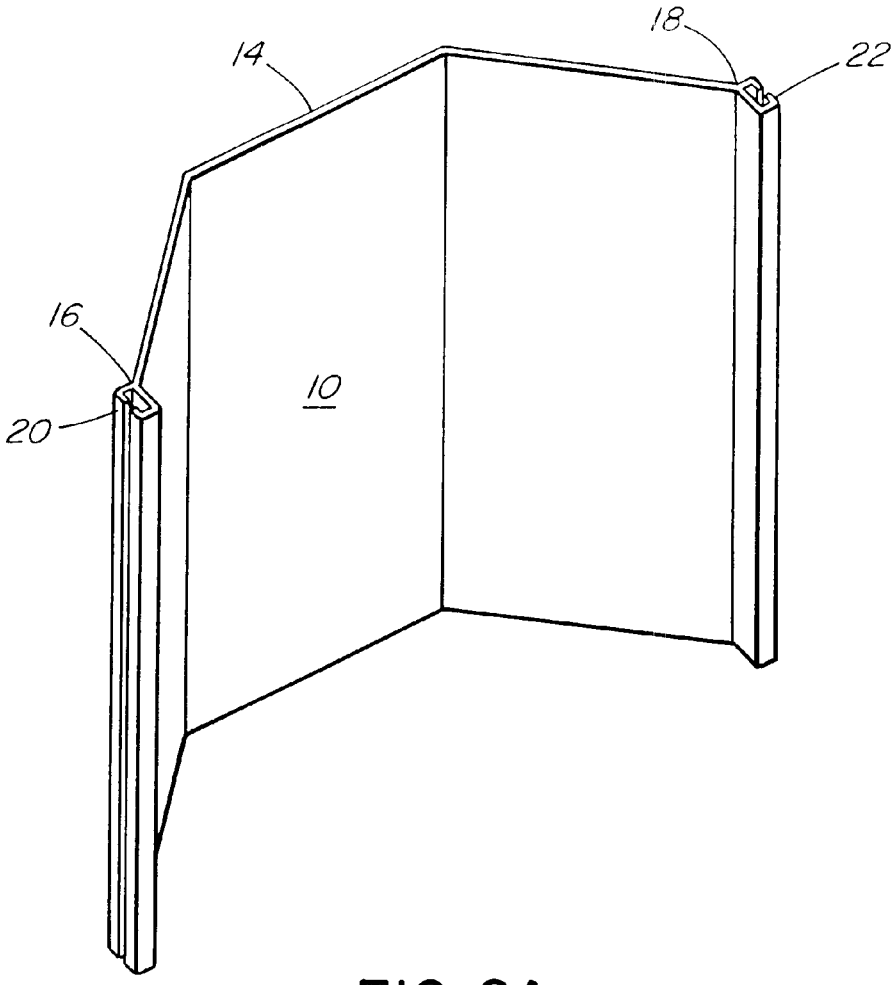
FIG. 2A is a perspective view of a concave wall element according to the invention.
Figure 2B:
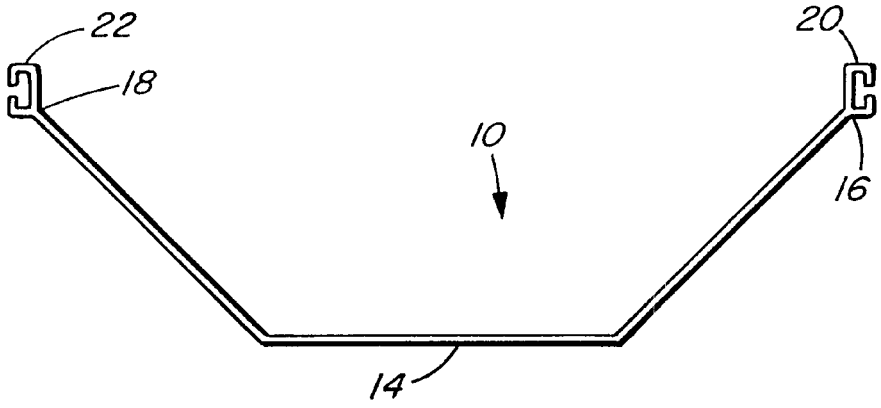
FIG. 2B is an edge view of a concave wall element according to the invention.

Referring to FIGS. 2A and 2B, wall element 10 has a surface 14 which may be three sided or it may have more sides, be rounded or any other suitable shape, provided the element is essentially open so that the edges do not close towards one another. In this disclosure and in the claims, such shapes are referred to for simplicity as "concave", and wall element 10 will hereafter be referred to as the "concave wall element". Engagement means 20, 22 extend along the longitudinal edges 16, 18 of the concave wall element. In the preferred embodiment, engagement means 20, 22 are C or channel shaped.

Figure 3:
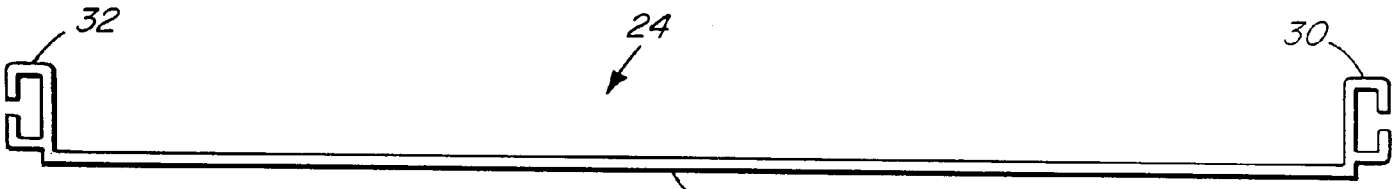
FIG. 3 is an edge view of a flat wall element according to the invention.

Referring to FIG. 3, wall element 24 comprises a portion 28 extending between the longitudinal edges of the element and having engagement means 30, 32 along its longitudinal edges. Portion 28 is flat on at least one side to present a flat external appearance to the completed wall. Wall element 24 will hereafter be referred to as the "flat wall element". In the preferred embodiment, engagement means 30, 32 are C or channel shaped.

Figure 4A:
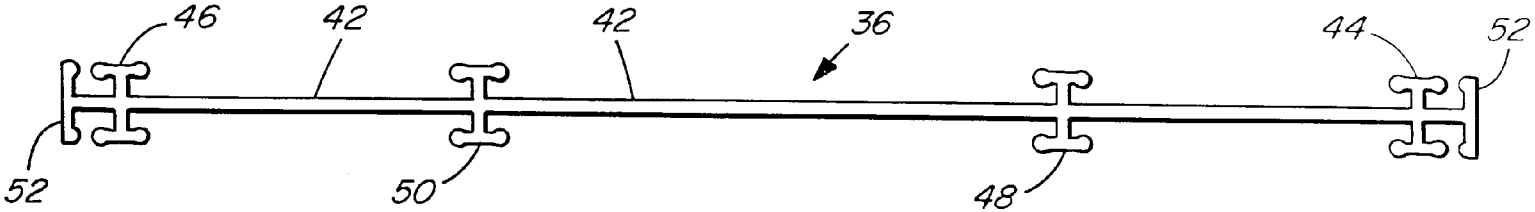
FIG. 4A is an edge view of a connecting member according to the invention.
Figure 4B:
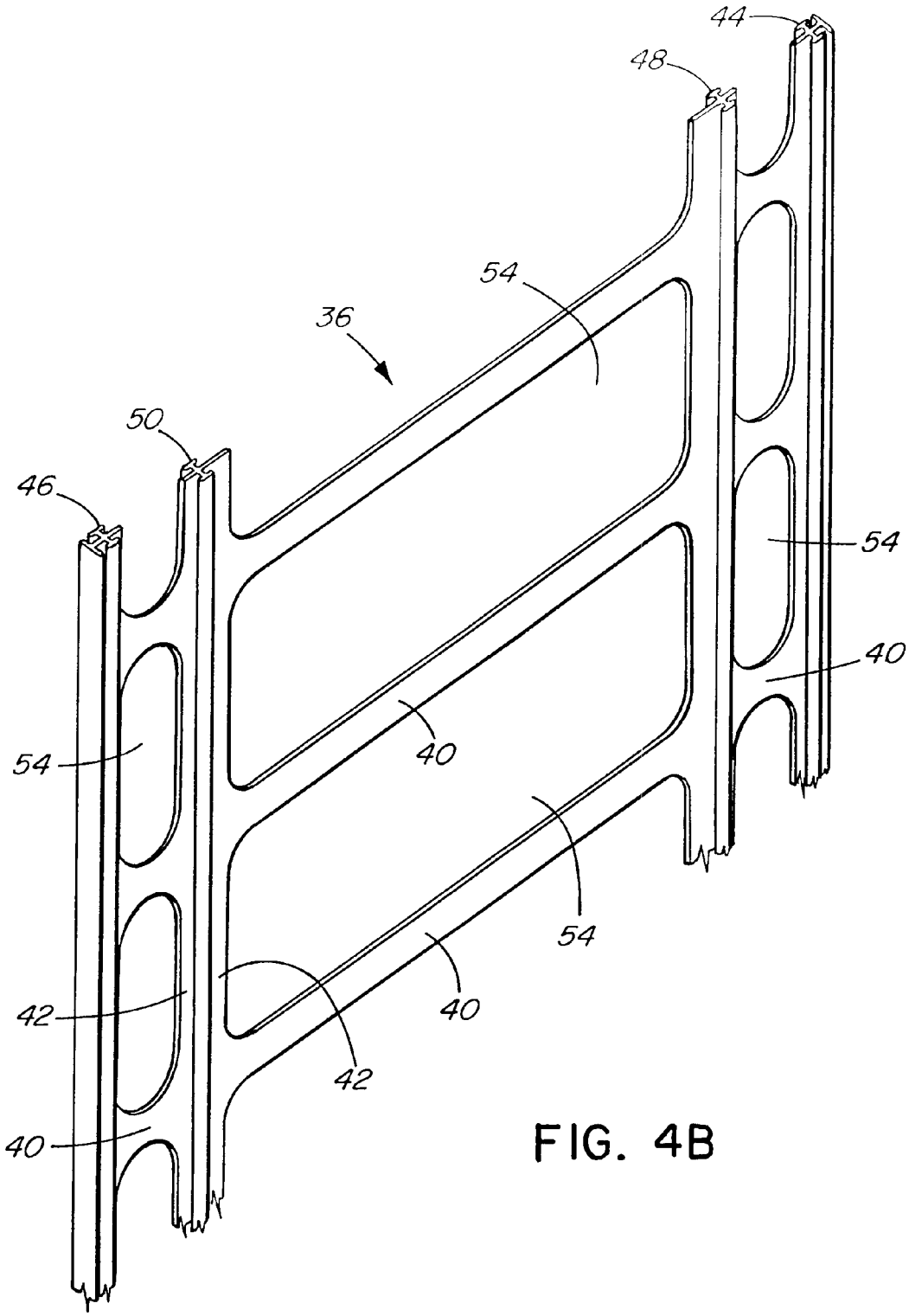
FIG. 4B is a perspective view of a connecting member according to the invention.

A connecting member 36 according to the invention is more particularly illustrated in FIGS. 4A and 4B. A series of ribs 40 extend in the central portion 42 along the length of the connecting member 36. Engagement means 44, 46 are provided along each longitudinal edge of the member 36. In the preferred embodiment, engagement means 44 consists of two T connectors disposed opposite one another in relation to the plane of central portion 42. The same arrangement is provided for engagement means 46. Each of the T connectors is sized to cooperate with the C or channel shaped engagement means 20, 22 of concave elements 10, 12 and engagement means 30, 32 of flat elements 24, 26.

An additional set of supplementary engagement means 48, 50 are provided a spaced distance inwardly of each longitudinal edge of the connecting member. The distance from the nearest longitudinal edge is the same for engagement means 48 as for engagement means 50. In the preferred embodiment, engagement means 48, 50 are also formed as T connectors disposed opposite one another in relation to the plane of central portion 42.

Each longitudinal edge of the connecting member 36 terminates in a flat end 52 extending perpendicular to the plane of the central portion 42.

Referring again to FIG. 1, erection of the formwork can be accomplished by positioning the engagement means 44, 46 of connecting member 36 in relation to engagement means 20, 22, 30 and 32 of two concave wall elements 12, 10 and two flat wall elements 24, 26 respectively, then sliding the connecting member 36 into engagement with the wall elements (i.e. into the plane of FIG. 1).

It will be appreciated that the connecting member 36 acts not only to hold the pairs of facing elements 10, 12 and 24, 26 a controlled distance from one another, but also to secure laterally adjacent elements 10 and 12 together and to secure laterally adjacent elements 24 and 26 together in edge to edge relationships.

Once one connecting member is slidingly engaged with a first set of four elements, another connecting member can be slid into engagement with the engagement means on the end of the elements opposite the connecting member which is already installed. Thus a wall of formwork is gradually erected. Since the engagement between the connecting members and the elements is a sliding one, the formwork or any given connecting member can be disassembled easily, provided the concrete has not been poured.

As noted above, the connecting member 36 is provided with ribs 40. Ribs 40 are spaced from one another a sufficient distance to ensure a minimum of impedance to the flow of concrete through the central portion 42. Ribs 40 define spaces 54 between them, thus allowing the introduction in the spaces 54 of reinforcing rods in the wall if needed.

Bulging of the formwork due to the outward pressure exerted by the concrete has been a problem in the prior art. In the formwork according to the invention, the problem is substantially avoided on the concave side of the wall by the use of the connecting members, and by to the concave shape of the wall elements which tends to distribute the pressure and accommodate the bulging.

Where concave elements are not used, other means are necessary to avoid outward bulging of the flat side of the wall. According to one aspect of the invention, a layer of rigid foam insulation 56 is provided against the inner surface of the flat wall. The layer of insulation 56 distributes the pressure from the concrete and is effective to prevent bulging of the formwork in addition to providing insulation properties. It is also within the scope of the invention to use wood panels, drywall sections or any other rigid panel on the interior surface of the formwork instead of rigid foam insulation.

In order to retain the rigid foam insulation 56 in abutment against the interior surface of flat elements prior to pouring the concrete, pieces of rigid foam insulation 56 are provided with notches or grooves 58 (best seen in FIG. 1) which are adapted to receive the engagement means 48, 50 of the connecting members 36. Pieces of rigid foam insulation may therefore be inserted in the formwork and retained in place prior to pouring the concrete.

Figure 5:
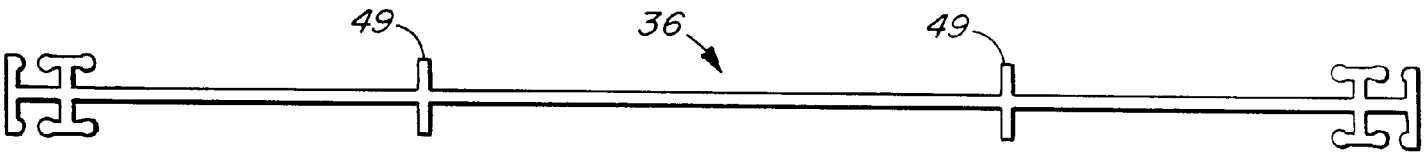
FIG. 5 is a plan view of an alternate embodiment of connecting member according to the invention.

In an alternate embodiment of the connecting member 36 illustrated in FIG. 5, the engagement means 48, 50 which were illustrated in the embodiment of FIG. 4A are replaced with straight flanges 49 which are adapted to cooperate with the notches 58 in the rigid foam panel. In this case it will be appreciated that narrower notches 58 may be used in the rigid panel.

Figure 6:
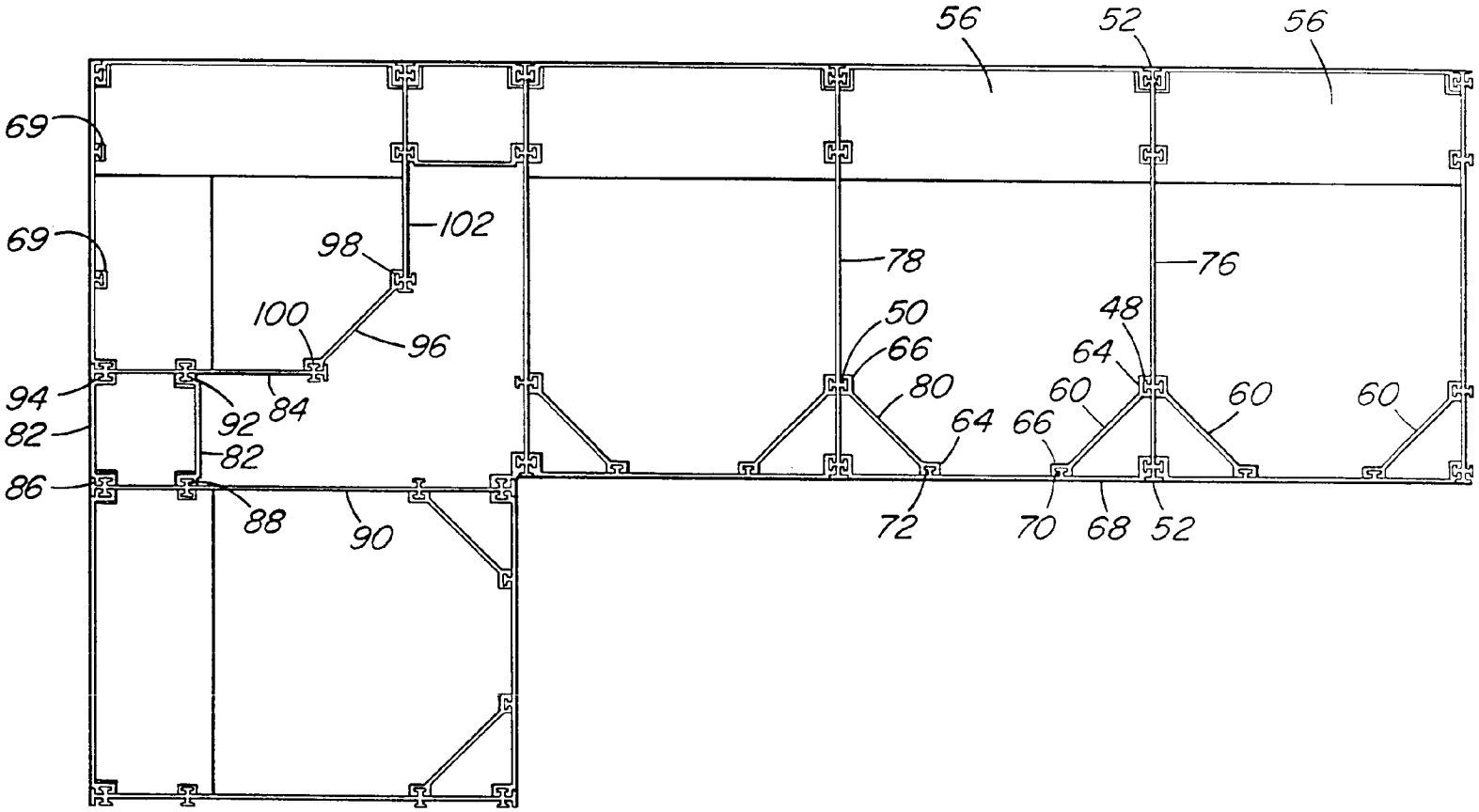
FIG. 6 is a plan view of an assembly of formwork illustrating connecting members and wall elements according to the invention to produce a wall having two flat sides.

The connecting members and wall elements can also be assembled so as to create two opposed flat walls as illustrated in FIG. 6. Where insulation is either not needed or not desired, bulging of the flat wall elements is prevented using 45° retaining elements 60 and modified flat wall elements 68.

Figure 7:
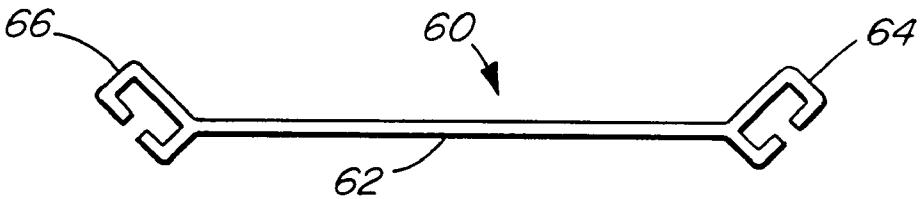
FIG. 7 is a plan view of a 45° retaining element according to the invention.

As more particularly illustrated in FIG. 7, 45° elements 60 include a flat portion 62, engagement means 64 extending at a 45 degree angle to the flat portion 62 and engagement means 66 extending at a 135 degree angle to the flat portion 62. These angles allow the 45° elements to be connected in diagonal relationship to the connecting members 36 and the modified flat wall elements 68.

Figure 8:
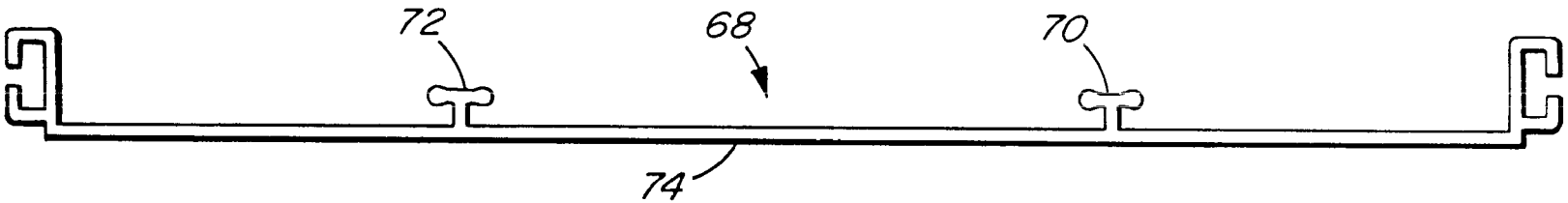
FIG. 8 is a plan view of a modified flat wall element according to the invention.

Modified flat wall elements 68 are illustrated in FIG. 8. They include the elements of the basic flat wall element 24 illustrated in FIG. 3 with the addition of a pair of engagement means 70, 72 extending to one side of flat central portion 74, and spaced inwardly from the longitudinal edges of the element.

As illustrated in the assembly of FIG. 6, 45° elements 60 are disposed so as to engage the engagement means of adjoining connecting members and modified flat wall elements. Engagement means 64 of the 45° element engages engagement means 48 of connecting member 76 and engagement means 66 of the 45° element engages engagement means 70 of modified flat wall element 68. Similarly, engagement means 66, 64 of 45° element 80 engages engagement means 72 of modified flat wall element 68 and engagement means 50 of connecting member 78. The 45° elements therefore act to withhold the modified flat wall elements against bulging due to the pressure of the poured concrete.

It will be appreciated that the interiorly disposed engagement means 48, 50 on the connecting members and interiorly disposed engagement means 70, 72 on the modified flat elements makes them versatile enough to be used with either flat or concave wall elements and with or without a panel of insulation or other pressure distributing component against the interior wall of the formwork. When used without insulation against a flat interior wall, the 45° elements 60 provide resistance against bulging of the formwork.

When modified flat wall elements 68 are used with a rigid panel, the panel is provided with additional notches or grooves to accommodate the engagement means of the flat wall elements as best illustrated at 69.

As seen in FIG. 1 and FIG. 6, the flat ends 52 of the connecting members 36 provide a flat bridge over the gap between adjacent edges of adjacent flat wall elements.

FIG. 6 also illustrates the creation of a corner using elements and members according to the invention. In the preferred embodiment, the width of the wall elements are not identical to the width of the connecting members. As a result, a transition in effective width of a section must be accomplished to accommodate a corner. This may be done using a short version of a flat wall element as at 82 and a truncated version of a connecting member as at 84. Two short flat wall elements 82 engage engagement means 86 and 88 of connecting member 90, and engagement means 92, 94 of truncated connecting member 84. 45° element 96 engages engagement means 98 of truncated connecting member 102 and engagement means 100 of truncated connecting member 84.

The various engagement means described in relation to the wall elements, the connecting members and the 45° elements are adapted to allow longitudinal sliding engagement between them. While the engagement means of the preferred embodiment have been described in some detail, variations on the specific structure of the engagement means may be practised provided there is a sliding engagement between the cooperating engagement means to enable the easy erection of the formwork. For example, while the preferred embodiment described above uses male T-connectors and female channel shaped engagement means, these may be interchanged, alternated or modified without departing from the scope of the invention.

It will be appreciated by those skilled in the art that other variations of the preferred embodiment may also be practised without departing from the scope of the invention.

What is claimed is:

1. A kit for erecting a concrete wall formwork comprising:

a plurality of elongated, generally concave wall elements having engagement means about their longitudinal edges;

a plurality of elongated, substantially flat wall elements having engagement means about their longitudinal edges;

a plurality of connecting members having engagement means about their longitudinal edges adapted for sliding engagement with the engagement means of said concave wall elements and of said flat wall elements;

said concave wall elements being adapted to be presented in edge to edge relationship to form a first face of a wall, said flat wall elements being adapted to be presented in edge to edge relationship to form a second face of a wall parallel to said first face, and said connecting member being adapted to slidingly extends between said first and second faces so as to simultaneously engage two edge adjacent concave wall elements of said first face and two edge adjacent flat wall elements of said second face.

2. A formwork assembly for erecting a concrete wall comprising:

a plurality of elongated, generally concave wall elements having engagement means about their longitudinal edges and being presented in edge to edge relationship to form a first face of a wall of said formwork;

a plurality of elongated, substantially flat wall elements having engagement means about their longitudinal edges and being presented in edge to edge relationship to form a second face of a wall of said formwork extending in parallel to said first face;

a plurality of connecting members having engagement means about their longitudinal edges, said engagement means being adapted for sliding engagement with the engagement means of said concave wall elements and of said flat wall elements, and at least one of said connecting members slidingly extending between said first and second faces so as to simultaneously engage two edge adjacent concave wall elements of said first face and two edge adjacent flat wall elements of said second face.

3. A formwork assembly as in claim 2 further comprising a plurality of elongated rigid panels extending substantially between adjacent pairs of connecting members and against an interior surface of said second face.

4. A formwork assembly as in claim 3 wherein said panels include longitudinally extending notches, said connecting members include longitudinally extending notch engagement means and wherein said notch engagement means are engaged in said notches.

5. A kit for erecting a concrete wall formwork comprising:

a plurality of elongated, substantially flat wall elements having engagement means about their longitudinal edges;

a plurality of connecting members having engagement means about their longitudinal edges adapted for sliding engagement with the engagement means of said flat wall elements;

said flat wall elements being adapted to be presented in edge to edge relationship to form two parallel rows of wall elements defining opposed faces of said formwork, and said connecting member being adapted to slidingly extends between said parallel rows so as to simultaneously engage two edge adjacent wall elements of one row and two edge adjacent wall elements of the opposed row.

6. A formwork assembly for erecting a concrete wall comprising:

a plurality of elongated, substantially flat wall elements having engagement means about their longitudinal edges and being presented in edge to edge relationship to form two parallel rows defining opposed faces of said formwork;

a plurality of connecting members having engagement means about their longitudinal edges, said engagement means being adapted for sliding engagement with the engagement means of said flat wall elements, and at least one of said connecting members slidingly extending between said parallel rows so as to simultaneously engage two edge adjacent wall elements of one row and two edge adjacent wall elements of the opposed row.

7. A formwork assembly as in claim 6 further comprising a plurality of elongated rigid panels extending substantially between adjacent pairs of connecting members and against an interior surface of at least one of said faces.

8. A formwork assembly as in claim 7 wherein said panels include longitudinally extending notches, said connecting members include longitudinally extending notch engagement means and wherein said notch engagement means are engaged in said notches.

9. A kit for erecting a concrete wall formwork comprising:

a plurality of elongated, first wall elements having engagement means about their longitudinal edges;

a plurality of elongated, second wall elements having engagement means about their longitudinal edges;

a plurality of connecting members having engagement means about their longitudinal edges adapted for sliding engagement with the engagement means of said first wall elements and of said second wall elements;

said first wall elements being adapted to be presented in edge to edge relationship to form a first face of a wall, said second wall elements being adapted to be presented in edge to edge relationship to form a second face of a wall parallel to said first face, and said connecting member being adapted to slidingly extend between said first and second faces so as to simultaneously engage two edge adjacent first wall elements of said first face and two edge adjacent second wall elements of said second face.

10. A kit for erecting a concrete wall formwork as in claim 9 wherein the connecting members are elongated and comprise a substantially straight portion extending between two longitudinal edges;

each of said longitudinal edges of said connecting members are provided with two elongated engagement means disposed in symmetrical opposed relationship about said straight portions each of said engagement means of said connecting members being adapted for sliding engagement with the engagement means of said wall elements.

11. A connecting member as in claim 10 further comprising at least one elongated supplementary engagement means spaced inwardly from one of said longitudinal edges.

12. A connecting member as in claim 11 wherein said supplementary engagement means comprises two separate engagement portions disposed in symmetrical opposed relationship about the plane of said straight portion.

13. A connecting member as in claim 12 further comprising two substantially identical supplementary engagement means, each of said supplementary engagement means being disposed an equal distance from one of said longitudinal edges of said connecting member.

14. A connecting member as in claim 11 wherein said supplementary engagement means comprises at least one straight flange extending perpendicular to said straight portion.

15. A connecting member as in claim 11 wherein each longitudinal edge of said connecting member comprises an elongated flat portion extending perpendicular to said straight portion.

* * * * *